US010258143B1

(12) United States Patent
Kenyon

(10) Patent No.: US 10,258,143 B1
(45) Date of Patent: Apr. 16, 2019

(54) ADJUSTABLE, FOLDABLE, EXPANDABLE, AND PORTABLE WORKSTATION

(71) Applicant: Colby Lee Kenyon, Wichita, KS (US)

(72) Inventor: Colby Lee Kenyon, Wichita, KS (US)

( * ) Notice: Subject to any disclaimer, the term of this patent is extended or adjusted under 35 U.S.C. 154(b) by 0 days.

(21) Appl. No.: 15/860,421

(22) Filed: Jan. 2, 2018

Related U.S. Application Data

(60) Provisional application No. 62/441,544, filed on Jan. 2, 2017.

(51) Int. Cl.

| | |
|---|---|
| ***A47B 3/10*** | (2006.01) |
| ***A47B 21/02*** | (2006.01) |
| ***A47B 3/083*** | (2006.01) |
| ***A45C 9/00*** | (2006.01) |
| ***A47B 1/04*** | (2006.01) |
| ***A47B 9/16*** | (2006.01) |
| ***A47B 9/20*** | (2006.01) |

(52) U.S. Cl.
CPC ..... *A47B 3/10* (2013.01); *A45C 9/00* (2013.01); *A47B 1/04* (2013.01); *A47B 3/083* (2013.01); *A47B 9/16* (2013.01); *A47B 9/20* (2013.01); *A47B 21/02* (2013.01)

(58) Field of Classification Search
CPC ..... A47B 3/10; A47B 9/16
USPC ..... 108/38, 35, 115, 118, 34, 116
See application file for complete search history.

(56) References Cited

U.S. PATENT DOCUMENTS

| | | | | | |
|---|---|---|---|---|---|
| 517,756 | A * | 4/1894 | Maurer | A47B 3/087 | 108/35 |
| 2,358,883 | A * | 9/1944 | Rothschild | A47B 3/087 | 108/35 |
| 2,652,300 | A * | 9/1953 | Graber | A47B 3/10 | 108/167 |
| 4,034,518 | A * | 7/1977 | Trecker | A45C 9/00 | 190/11 |
| 4,210,085 | A * | 7/1980 | McLravy, II | A47B 3/02 | 108/118 |
| 4,378,828 | A * | 4/1983 | Shiminski | B25H 1/04 | 108/35 |
| 4,531,642 | A * | 7/1985 | Racich | B43L 13/005 | 211/42 |
| 4,887,536 | A * | 12/1989 | Teichner | A45C 9/00 | 108/35 |
| 4,895,418 | A * | 1/1990 | Medellin | B67D 1/06 | 108/38 |
| 5,660,117 | A * | 8/1997 | Noble | A47B 23/043 | 108/35 |

(Continued)

*Primary Examiner* — Jose V Chen
(74) *Attorney, Agent, or Firm* — Plager Schack LLP

(57) ABSTRACT

A sit to stand workstation may include a right platform attached, such as hingeably attached, to a left platform; a pair of left upper legs pivotally attached to a bottom surface of the left platform; a pair of right upper legs pivotally attached to a bottom surface of the right platform; a leg axle operatively connected to an end of each of the left upper legs distal from the left platform and to an end of each of the right upper legs distal from the right platform; a pair of lower right legs operatively connected to the leg axle; a pair of lower left legs operatively connected to the leg axle; removable tray attachments removably engaged with a surface of the right platform or the left platform; and storage compartments removably attached to the workstation when the right platform and the left platform are in a folded configuration.

12 Claims, 4 Drawing Sheets

(56) References Cited

U.S. PATENT DOCUMENTS

| | | | | |
|---|---|---|---|---|
| 6,974,185 | B2 * | 12/2005 | Hsieh | A47C 3/36 108/117 |
| 7,287,730 | B1 * | 10/2007 | Chen | B25H 1/04 108/118 |
| 7,779,762 | B2 * | 8/2010 | Sackman | A47B 13/081 108/25 |
| 9,770,096 | B1 * | 9/2017 | Meyer | A47B 3/10 |
| 2004/0237849 | A1 * | 12/2004 | Zhurong | A47B 3/0912 108/35 |
| 2006/0238090 | A1 * | 10/2006 | Jordan | A47B 3/083 312/352 |
| 2007/0028812 | A1 * | 2/2007 | Dumond | A47B 3/087 108/36 |
| 2007/0215011 | A1 * | 9/2007 | Khan | A45C 9/00 108/11 |
| 2008/0149802 | A1 * | 6/2008 | Chiang | A47B 3/083 248/461 |
| 2012/0204770 | A1 * | 8/2012 | Grace | A47B 3/002 108/116 |
| 2014/0054299 | A1 * | 2/2014 | Kannin | F25D 23/00 220/592.2 |
| 2017/0245608 | A1 * | 8/2017 | King | A47B 3/10 |

* cited by examiner

ADJUSTABLE, FOLDABLE, EXPANDABLE, AND PORTABLE WORKSTATION

RELATED APPLICATION

This application claims priority to provisional patent application U.S. Ser. No. 62/441,544 filed on Jan. 2, 2017, the entire contents of which is herein incorporated by reference.

BACKGROUND

The embodiments herein relate generally to office furniture, and more particularly, to a lightweight, height adjustable, and folding sit to stand workstation.

Sitting for extended periods of time contributes to a variety of adverse health effects. However, standing for several hours can be uncomfortable and impractical.

Devices exist that attempt to alleviate these issues. However, conventional sit to stand workstations are bulky, heavy, and do not fold in half, meaning they are not easily portable. Most sit to stand workstations for laptops do not elevate high enough for a user to utilize it in conjunction with exercise equipment. Conventional sit to stand workstations are incapable of doubling as a laptop carrying case or briefcase. Conventional sit to stand workstations specifically designed for laptops cannot expand to accommodate personal computer accessories.

Therefore, what is needed is a device that allows a user to seamlessly transition between working while seated and standing, wherein the device is lightweight, can be folded or otherwise condensed for transport and storage, can be substantially expanded in width and depth to accommodate personal computer accessories, doubles as a laptop case or briefcase, has a minimal height when fully lowered, and is capable of elevating to substantial heights.

SUMMARY

Some embodiments of the present disclosure include a sit to stand workstation may include a right platform attached, such as hingeably attached, to a left platform; a pair of left upper legs pivotally attached to a bottom surface of the left platform; a pair of right upper legs pivotally attached to a bottom surface of the right platform; a leg axle operatively connected to an end of each of the left upper legs distal from the left platform and to an end of each of the right upper legs distal from the right platform; a pair of lower right legs operatively connected to the leg axle; a pair of lower left legs operatively connected to the leg axle; removable tray attachments removably engaged with a surface of the right platform or the left platform; and storage compartments removably attached to the workstation when the right platform and the left platform are folded.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
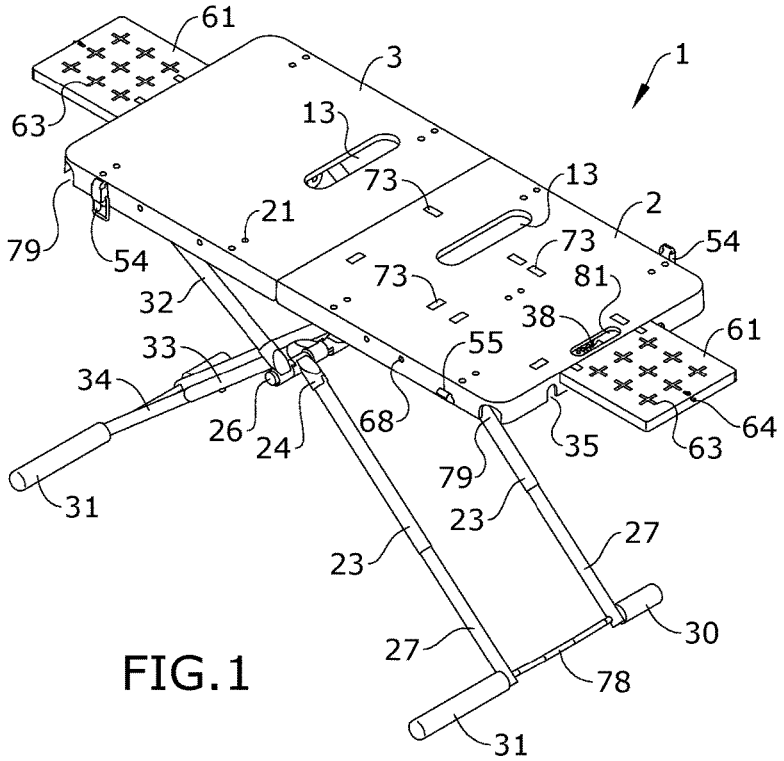
FIG. 1 is a perspective view of one embodiment of the present disclosure.

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used as a sit to stand workstation and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

| | |
|---|---|
| a. Right Platform | f. Telescoping Upper Leg |
| b. Left Platform | g. Anti-Tip Supports |
| c. Removable Tray Attachments | h. Customizable Storage Compartments |
| d. Scissor Legs | i. Monitor Securement Clip |
| e. Telescoping Lower Leg | j. Spring Loaded Hinge |

The various elements of the device of the present disclosure may be related in the following exemplary fashion. It is not intended to limit the scope or nature of the relationships between the various elements and the following examples are presented as illustrative examples only.

By way of example, and referring to FIGS. 1-11, some embodiments of the present disclosure include a height adjustable and portable sit to stand workstation 1, the workstation 1 comprising a right platform 2 attached to a left platform 3; a ventilation shaft 13 extending through each of the right platform 2 and the left platform 3; a pair of left upper legs 32 pivotally attached to a bottom surface of the left platform 3; a pair of right upper legs 22 pivotally attached to a leg mount 39 which intersects a leg carriage 37 straddling a lead screw 36 secured to a bottom surface of the right platform 2; a leg axle, such as an elongate clevis pin 26, operatively connected to an end of each of the pair of left upper legs 32 distal from the left platform 3 and operatively connected, via leg joints 24, to an end of each of the pair of right upper legs 22 distal from the right platform 2; a pair of lower right legs operatively connected to the leg axle; a pair of lower left legs operatively connected to the leg axle; optionally, at least one removable tray attachment 61 removably engaged with a surface of the right platform 2 or the left platform 3; and optionally, customizable storage compartments 47 designed to removably attach to the workstation 1 when the platforms 2, 3 are in a folded configuration, wherein the left upper legs 32, right upper legs 22, left lower legs, and right lower legs work together with leg joints 24 on the leg axle to create a scissor-leg construction and wherein each of the left upper legs 32, right upper legs 22, left lower legs, and right lower legs can fold flat against a bottom surface of the workstation 1. Moreover, the angle at which the scissor legs are open may define the height of the workstation 1. In some embodiments of the invention, the bottom surface of the right platform 2 may feature two simple support blocks proximate to its right corners, and the bottom surface of the left platform 3 may feature two identical offset support blocks proximate to its left corners. The support blocks support the platforms 2, 3 when they are completely lowered. The bottom surface of the left platform 3 may feature depressions that align with the support blocks on the right platform 2 when the workstation 1 is folded and vice versa. Due to these aligned depressions in the bottom of the platforms 2, 3, the support blocks do not prevent the workstation from completely folding.

Figure 3:
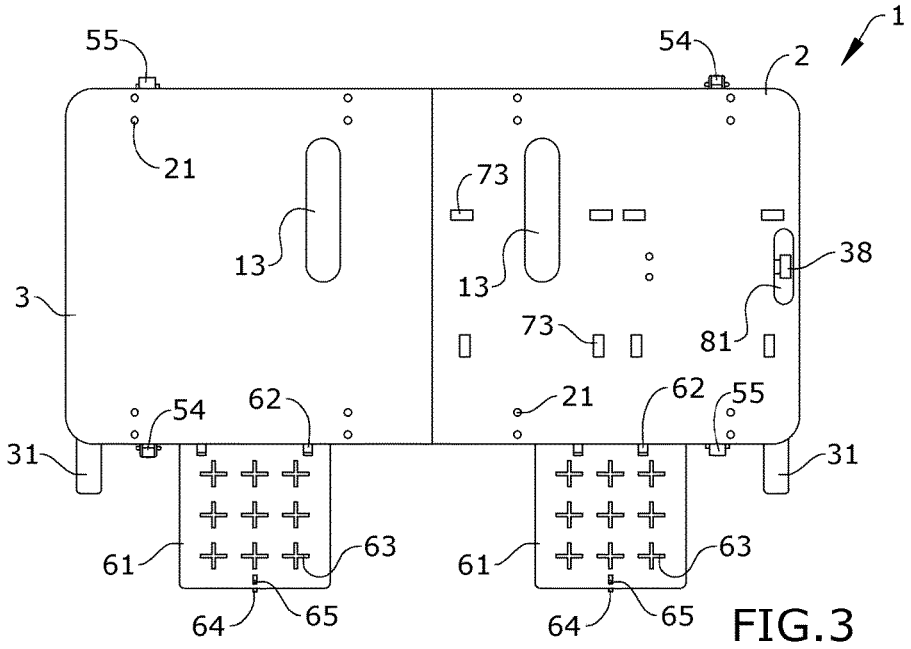
FIG. 3 is a top view of one embodiment of the present disclosure.
Figure 4:
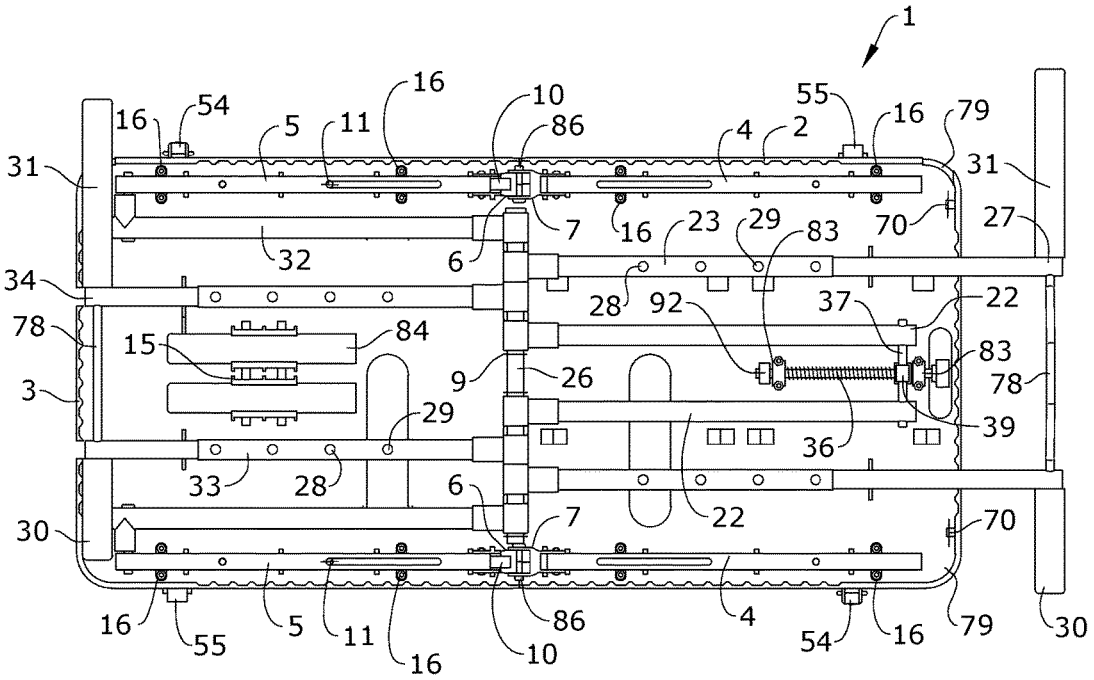
FIG. 4 is a bottom view of one embodiment of the present disclosure.
Figure 5:
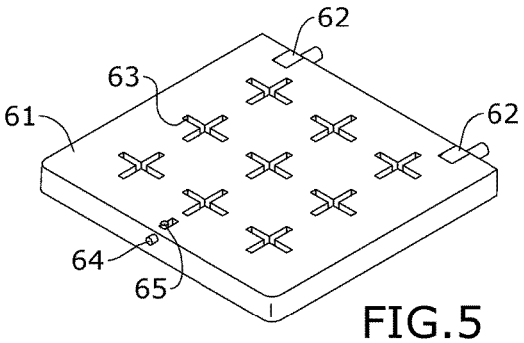
FIG. 5 is a top perspective view of one embodiment of the present disclosure.
Figure 6:
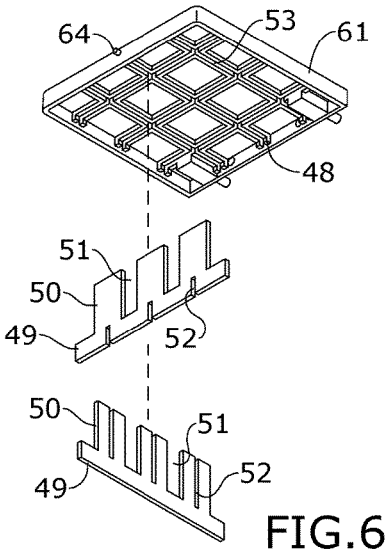
FIG. 6 is a bottom perspective view of one embodiment of the present disclosure.
Figure 11:
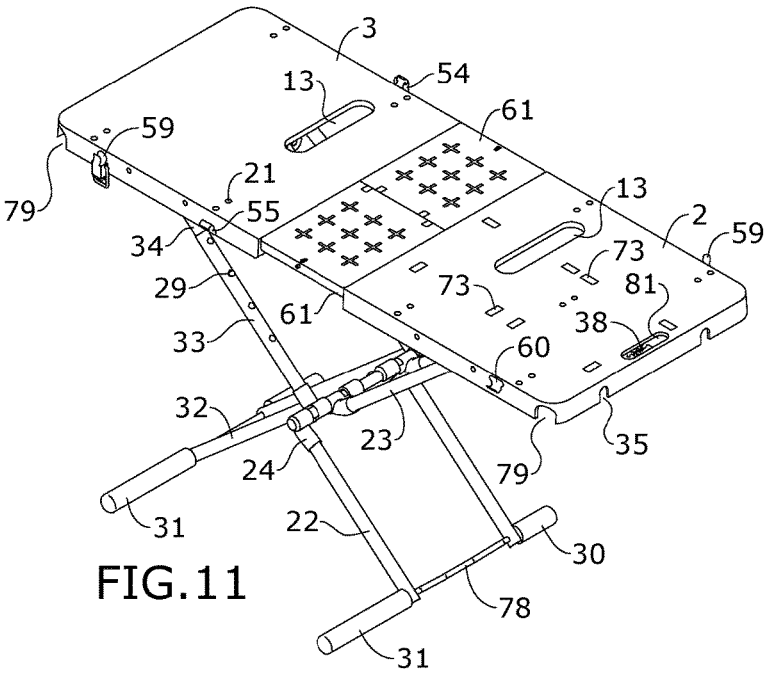
FIG. 11 is a top perspective view of one embodiment of the present disclosure.

The workstation 1 of the present disclosure may further comprise removable tray attachments 61, wherein the removable tray attachments 61 may attach to a portion of each of the right platform 2 and left platform 3 to expand the tabletop size of the workstation 1. For example, as shown in FIG. 1, the removable tray attachments 61 may be attached to the left edge of the left platform 3 and/or the right edge of the right platform 2 via tray braces 62 that snap or otherwise engage with tray brace receptacles 68 on the platforms 2, 3. In this embodiment, the traveling lower leg segments 27, 34 may be extended to prevent tipping. Alternatively, as shown in FIG. 3, the removable tray attachments 61 may attach to a front or rear edge of at least one of the left platform 3 and the right platform 2 by inserting the tray braces 62 into tray brace receptacles 68 on the platforms 23. In this embodiment, retractable or detachable anti-tip supports, such as long boots 31, may be added to the front or rear of the leg crossbars 78 (described in more detail below) to prevent tipping. In some embodiments, the tray attachments 61 may be permanently connected to the respective platforms 2, 3 and may slide out for usage. As shown in FIG. 11, the removable tray attachments 61 may be inserted and attached between the right edge of the left platform 3 and the left edge of the right platform 2. Removable tray attachments 61 may attach to one another by inserting tray braces 62 from a first removable tray attachment 61 into tray brace receptacles 68 on the second removably tray attachment 61. In this third embodiment, the left upper legs 32 and the right upper legs 22 may expand, telescopically or otherwise, to allow the left platform 3 and the right platform 2 to be spaced apart at a central portion of the workstation 1, as shown in FIG. 11. In this embodiment, tray braces 62 on the right surface of the left platform 3 and the left surface of the right platform 2 insert into additional tray brace receptacles 68 on the sides of the removably tray attachments 61. When the removable tray attachments 61 are attached to the right platform 2 and/or left platform 3, an upper surface of the tray attachments 61 may be level with a top surface of each platform 2,3.

Figure 7:
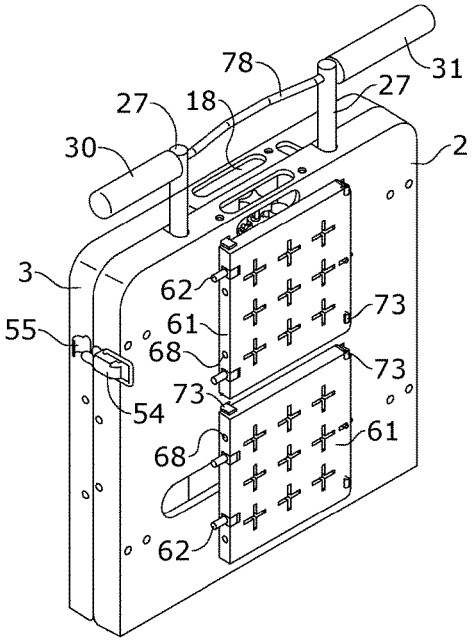
FIG. 7 is a perspective view of one embodiment of the present disclosure.

Each removable tray attachment 61 may comprise a plurality of narrow vertical and horizontal divider passage slots 63, wherein a horizontal divider slot may intersect a vertical divider passage perpendicularly. Each slot 63 may allow for the passage of a divider tooth 50 therethrough, which is explained in more detail below. As shown in FIG. 7, when the workstation 1 is not in use, each of the removable tray attachments 61 may be attached to a top or bottom surface of a platform 2, 3 using pivoting tray clips 73 for transport and storage purposes.

The bottom surface of each removable tray attachment 61 may include features, such as a groove or depression, that allows it to function as, for example, a cup holder or cell phone when it is flipped upside down and attached to a platform 2, 3.

Figure 9:
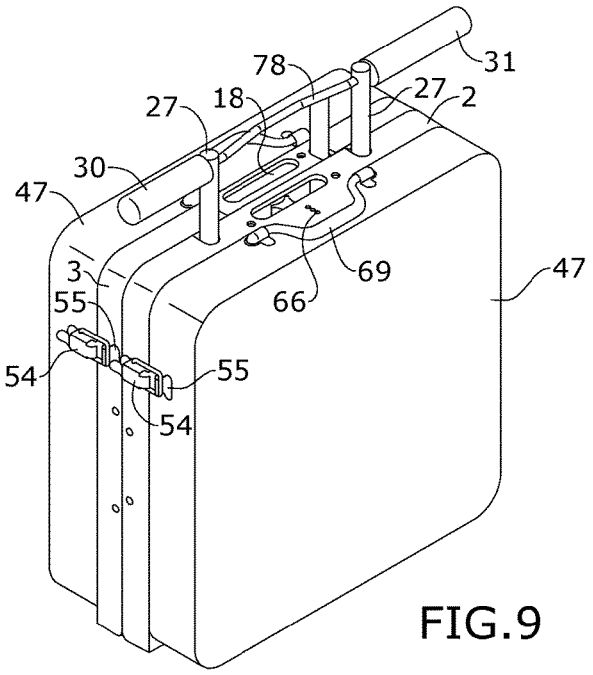
FIG. 9 is a perspective view of one embodiment of the present disclosure.

When in a folded state, the workstation 1 may double as a case, such as a briefcase, as shown in FIGS. 7 and 9. In its folded state, the workstation 1 may latch or lock together to secure the platforms 2, 3 in a folded configuration. The leg crossbars 78 (described in more detail below) may extend past an outer edge of each of the platforms 2, 3 to form a secondary handle when the workstation 1 is folded. Moreover, as described in more detail below, additional storage compartments 47 may be attached to the workstation 1 for additional storage.

In embodiments, the right platform 2 may either be hingeably attached to the left platform 3, or the right platform 2 may be removably attached to the left platform 3, such that the right platform 2 may separate from the left platform 3 while not in use or to attach removable tray attachments 61 therebetween to expand the width of the workstation 1. For example, the right platform 2 may be hingeably attached to the left platform 3 via a pair of hinges, wherein each hinge includes an inner hinge 6 and outer hinge 7, the inner hinge 6 being attached to the right edge of the left platform 3, and the outer hinge 7 being attached to the left edge of the right platform 2.

The right platform 2 and the left platform 3 may each be substantially rectangular shaped. The right platform 2 may include right rectangular framing tubes 4 attached to a bottom surface thereof via rail flanges 16 that may be attached to the bottom surface of the right platform 2 using any conventional fastener, such as screws, wherein the rectangular framing tubes 4 may extend from a left edge of the right platform 2 (i.e., the edge adjacent to the left platform 3 when the workstation 1 is in a deployed state) to a right edge of the right platform 2 proximate to front and back surface of the right platform 2. Each of the outer hinges 7 may be attached to one of the right rectangular framing tubes 4 via conventional fasteners, such as screws. Similarly, the left platform 3 may include left rectangular framing tubes 5 positioned in a manner similar to the right rectangular framing tubes 4 but on the left platform 3. Each of the inner hinges 6 may be attached to one of the left rectangular framing tubes 5 via fasteners. The ends of each of the inner hinges 6 and outer hinges 7 may be substantially rounded, wherein each inner hinge 6 may overlap with an outer hinge 7 and an orifice in each of the inner hinges 6 and outer hinges 7 may align such that a fastener may pass through both the inner hinge 6 and the outer hinge 7, allowing the respective framing tubes 4 to pivot up to 90°, resulting in the right platform 2 being hingeably attached to the left platform 3.

Each of the right rectangular framing tubes 4 and left rectangular framing tubes 5 may be substantially hollow. With respect to the right rectangular framing tubes 4, being hollow may allow a platform lock bolt 10 to be slid therein to lock the platforms 2, 3 in an open configuration for usage. The left rectangular framing tubes 5 may include a pair of holes drilled therethrough, allowing for the passage of a spring-loaded pin, which may lock the platform lock bolt 10 in place. The lock bolt 10 may be a bolt used to brace the center of the workstation 1 when it is in an open configuration. A first lock bolt 10 may be housed inside the left rectangular framing tube 5 near the rear of the left platform 3, and a second platform lock bolt 10 may be housed inside the left rectangular framing tube 5 near the front of the left platform 3. An orifice may extend through each platform lock bolt 10 proximate to its center. A T-bar shaft 11 or other type of pin loaded with a compression spring 20 may pass through the orifice in each lock bolt 10 and into an aligned orifice in the bottom surface of the left platform 3, which functions as a pin receptacle. After unfolding the platforms 2, 3, a user may slide each platform lock bolt 10 so that it bridges the center of the workstation 1. Each T-bar shaft 11 may then align with and be pushed by the spring into a second pin receptacle in the left platform 3, locking the platform bolt 10 in place. To unlock the platform lock bolt 10, a user may pull on a shaft ring 12 connected to the top of the T-bar shaft 11. Doing so may withdraw the T-bar shaft 11 from the pin receptacle.

Figure 2:
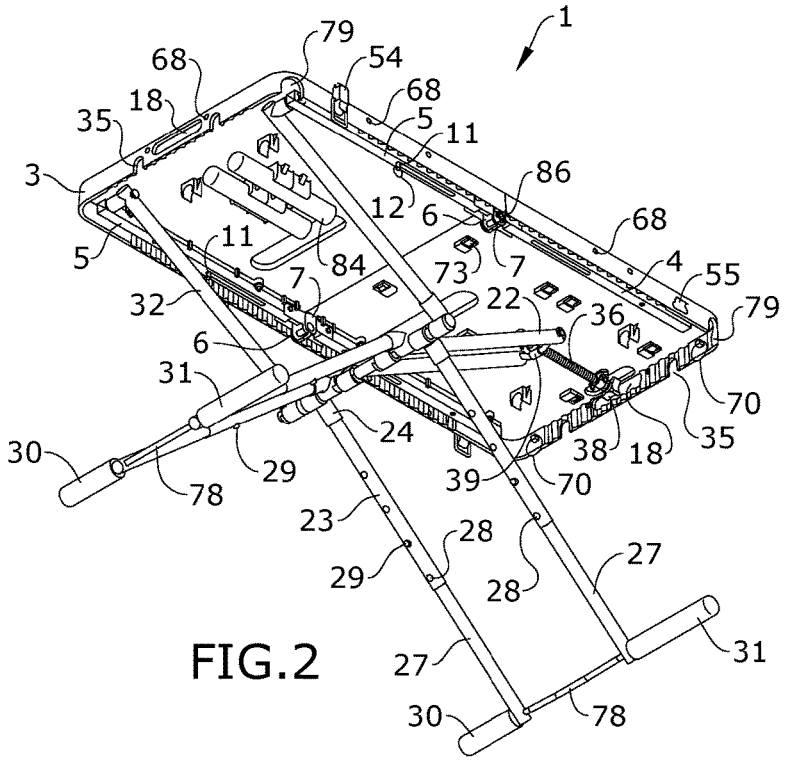
FIG. 2 is a bottom perspective view of one embodiment of the present disclosure.

Each of the right platform 2 and the left platform 3 may include a ventilation shaft 13 extending therethrough. At least one edge of each of the platforms 2, 3 may include a handle orifice 18 extending therethrough. The handle orifice 18 may allow a user to insert his or her fingers therein to carry the workstation 1 when it is folded. As shown in FIG. 2, each platform 2, 3 may further comprise a tie down ring 70 affixed to a corner thereof. These tie down rings 70 may allow a user to attach, for example, a shoulder strap (not shown) to the workstation 1 to allow a user to carry the workstation 1 when it is folded. At least one of a right edge of the right platform 2 and a left edge of the left platform 3 may comprise a gap, such as two identical gaps, cut therein, wherein the gaps are aligned and sized to accept a traveling leg segment 27, 34 when the legs are extended and completely folded as shown, for example, in FIG. 4. This allows the workstation 1 to lay completely flat in an open configuration and to fold the workstation 1 without needing to collapse the lower legs. The bottom surface of either the right platform 2 or left platform 3 may include ribs or other supporting structures. The bottom surface of each of the platforms 2, 3 may further comprise leg clips 14 designed to accept the lower leg segments to clip the lower leg segments to a bottom surface of a platform 2, 3. Lastly, the bottom surface of at least one of the platforms, such as the left platform 3, may include boot clips 15 to clip boots 30, 31, 84 (described in more detail below) to the workstation 1 for storage and transportation.

Both platforms 2, 3 may include a sloped orifice in the front and rear surface of the platform to create a gap, allowing a user to access the heads of spring-loaded locking platform axles 86. Each platform axle 86 may feature a connected pin which is pushed by the compression spring through aligned orifices in the inner hinge 6 and outer hinge 7 when the platforms 2, 3 are folded and through another set of orifices in the inner hinge 6 and the outer hinge 7 when the platforms 2, 3 are unfolded. The spring-loaded platform axles 86 thus lock the platforms 2, 3 when folded and when unfolded.

As described above, the ends of each of the left upper legs 32 and the right upper legs 22 distal from the platforms may be attached to a leg axle, such as clevis pin 26, via leg joints 24. The clevis pin 26 may function as a fulcrum for the legs, creating scissor legs from the interaction of the left upper legs 32, right upper legs 22, left lower legs, and right lower legs. Specifically, the clevis pin 26 may pass through a plurality of leg joints 24, wherein each leg joint 24 comprises a hollow tube sized to accommodate the clevis pin 26 and also includes a receptacle sized to accommodate an end of the left and right upper legs 32, 22 distal from the platforms 2, 3 and an end of the left and right lower legs distal from the anti-tip boots 31. Each leg joint 24 may also include a joint protrusion, wherein the protrusion on a leg joint 24 attached to an upper leg may press against a protrusion on a leg joint 24 attached to a lower leg to prevent the legs from unfolding beyond 0° or 180° and keep the leg erect when the workstation 1 is in use. Due to the engagement of the legs to the leg joints 24 and the leg joints 24 encircling the clevis pin 26, the legs may be allowed to fold and unfold with respect to the bottom surface of the workstation 1. The clevis pin 26 may also comprise a plurality of grooves to which retaining rings 9 may be attached. The retaining rings 9 may be positioned to prevent the leg joints 24 from moving along a length of the clevis pin 26, thus preventing the leg segments from sliding along the clevis pin 26.

The right upper legs 22 may each be pivotally connected to a traveling leg mount 39. The leg mount 39 may be attached to a leg carriage 37 designed to travel along a threaded shaft of a lead screw 36 attached to a bottom surface of the right platform 2 via lead screw caps 83, which may hold the lead screw 36 in place while allowing it to rotate. A lead screw collar 92 may be attached to an end of the lead screw 36 to prevent it from exiting the lead screw cap 83. Due to the above structure, the movement of the leg carriage 37 along the lead screw 36 may induce movement of the leg mount 39 which, in turn, causes the workstation's scissor legs to fold or unfold depending upon the direction in which the lead screw 36 is rotated. Moreover, the lead screw 36 may be rotated by turning a knob, such as a star knob 38, attached to an end of the lead screw 36. The knob may be accessible through a knob access orifice 81 in the surface of the right platform 2. While this structure is envisioned to allow the upper right leg 22 to travel along the bottom of the right platform 2 to provide for opening and closing of the scissor legs, other structures allowing for the traveling along the bottom of the right platform 2 are also envisioned. Particularly, the actuation mechanism could include an electric actuation mechanism, wherein a battery powered rocker switch may activate a motor whose axle would turn the lead screw 36.

The workstation 1 may also comprise a right lower leg segment and a left lower leg segment. In some embodiments, the lower leg segments may each comprise a right fixed lower leg segment 23 and a left fixed lower leg segment 33, respectively. A fixed lower leg segment 23, 33 may comprise a tube with two ends, the first of which is inserted into a leg segment receptacle on a leg joint 24. A second end of the fixed lower leg segment 23, 33 may be sized to accommodate a traveling lower leg segment 27, 34 such that the traveling lower leg segment 27, 34 emerges from the second end of the fixed lower leg segment 23, 33. Each fixed lower leg segment 23, 33 may include a plurality of leg extension orifices 28 extending therethrough, wherein each orifice 28 is sized to accommodate a leg extension pin 29 when it is aligned with the orifice 28. Thus, the traveling lower leg segments 27, 34 may be telescoping legs that telescope into and out of the fixed lower leg segments 23, 33 and lock into place via a leg extension pin 29.

An end of each traveling lower leg segment 27, 34 distal from the fixed lower leg segment 23, 33 may attach to a crossbar 78 which also attaches to the adjacent traveling lower leg segment 27, 34. Thus, each right traveling lower leg segment 27, 34 is attached to a single right crossbar 78 and each left traveling lower leg segment 34 is attached to a single left crossbar 78. A traveling leg passage gap 35 in the left surface of the left platform 3 may allow the right lower leg segments to extend past the end of the left platform 3, and a traveling leg passage gap 35 in the right platform 2 allow the left lower leg segments to extend past the end of the right platform 2. Additionally, each crossbar 78 may comprise an end extending past each traveling lower leg segment 27, 34. A boot may be applied to each end of the crossbar 78. For example, a short boot 30 may be placed over a front end of the crossbar 78. A long anti-tip boot 31 may be identical to the short boots 30 but substantially longer. The long boot 31 may be used to prevent the workstation 1 from tipping over when removable tray attachments 61 are attached to the front of the platforms 2, 3. Additionally, when the platforms 2, 3 are completely lowered, a boot passage gap 79 in each platform 2, 3 may align with and accept the long boot 31 to allow the workstation 1 to completely lower. The workstation 1 may further comprise counterweight boots 84 fabricated from a heavy material that acts to prevent tipping. In some embodiments, the boots 30, 31, 84 may also removably connect to the ends of the lower leg segments to increase leg length. In any case, when not in use, the boots 30, 31, 84 may be attached to the boot clips 15 on the bottom of a platform 2, 3.

As an alternate to boots 30, 31, 84, the workstation 1 may comprise retractable anti-tip supports housed inside the leg crossbars 78 that can deploy past the front of the platforms 2, 3.

Figure 10:
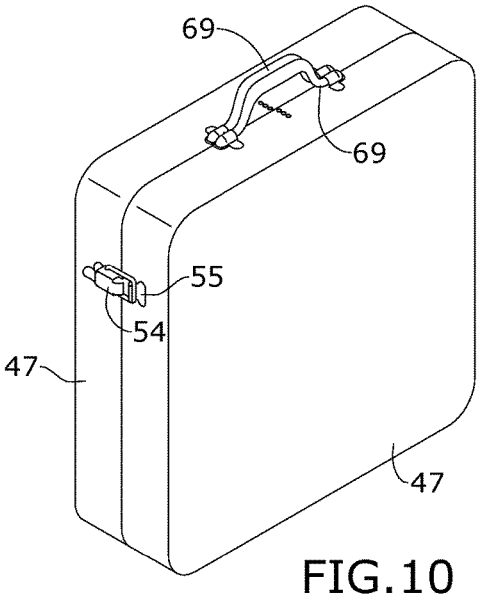
FIG. 10 is a perspective view of one embodiment of the present disclosure.

As shown in, for example, FIGS. 5-10, some embodiments of the workstation 1 may further comprise removable storage compartments 47 designed to removably attach to the platforms 2, 3. The storage compartments 47 may be sized to accommodate any item desired to be stored, such as a laptop, power block, other electronic devices, and personal items. A first latch 54 may be attached to a front of the compartment and a second latch 54 may be connected to a rear of the compartment. The latches 54 may be used to removable lock the compartment 47 to a platform 2, 3 by aligning latch arms 55 on the latches 54 with a latch catch (not shown) on the platform 2, 3. Alternatively, other fastening structures may be used. As shown in FIG. 9, attaching the compartment(s) 47 to the platforms 2, 3 may transform the device into a briefcase. As shown in FIG. 10, in embodiments including two compartments 47, the compartments 47 may attach to each another to create a standalone storage case (i.e., compartment briefcase 93). At least one of the compartments 47 may include a compartment handle 69. In some embodiments, each compartment 47 includes a compartment handle 69, wherein the two handles 69 come together to form a single handle to carry the compartment briefcase 93. A tie-down ring 70 may be attached to each of the compartments 47 to allow a user to connect a shoulder strap thereto.

In embodiments, the interior of each compartment 47 may be lined with a padding material to prevent damage to items stored therein. A symmetrical series of divider mounts 48 may line the front, rear, left, and right surfaces of the compartment's interior. Each divider mount 48 may be designed to hold an end of an insertable divider 49 in place, wherein the divider mount 48 comprises a pair of flexible protrusions with a narrow channel therebetween, which allows for the insertion of the divider 49. The floor of each compartment 47 may include an arrangement of linear channels 53 that align with all possible configurations of insertable dividers 49. To use a divider 49, a user inserts its first end into a divider mount 48 lining one of the compartment's interior walls and its opposite end into a divider mount 48 on the opposite side of the compartment 47. When a divider 49 is placed into a compartment 47, the bottom surface of the divider's shaft is pressed into a channel 53 in the floor of the compartment 47. The channel 53 may help hold the divider 49 in place while in use. Due to the structure of each divider 49, which will be described in more detail below, each divider 49 may be intersected perpendicularly by multiple other dividers 49 to create various sized and shaped subcompartments within the compartment 47.

Figure 8:
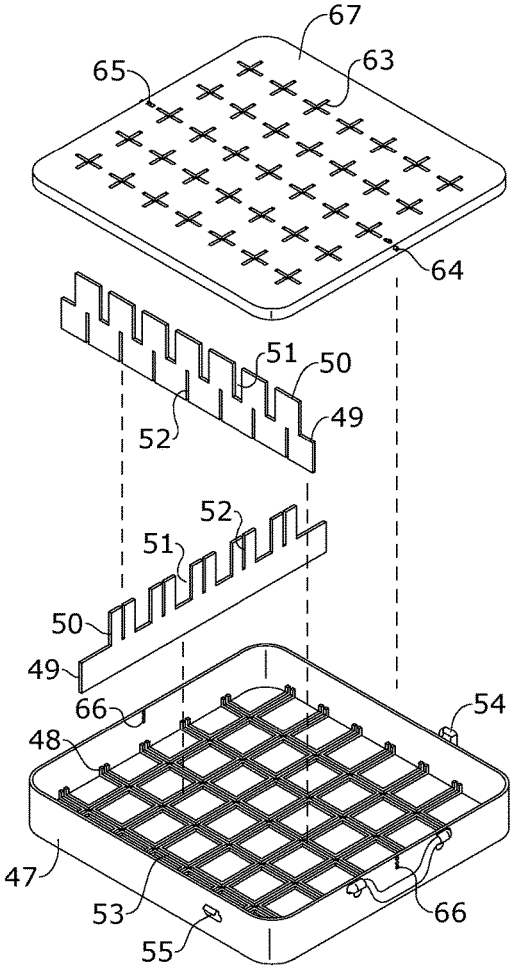
FIG. 8 is an exploded view of one embodiment of the present disclosure.

As shown, for example, in FIG. 8, each compartment 47 may include a series of lid lock orifices 66 on at least two walls of the compartment 47. The lid lock orifices 66 are sized to accommodate a spring-loaded lid pin 64 extending from a compartment lid 67. The removable tray attachments 61 may removably attach to each other via insertion of tray braces 62 into slots/receptacles 68 to form a single compartment lid. Each removable tray attachment 61 may therefore feature a spring-loaded lid lock pin 64 extending therefrom. Insertion of the spring-loaded pins 64 into the lid lock orifices 66 allows a user to lock a compartment lid 67 or removable tray attachment 61 at a desired height to secure the personal items within the compartment 47. To disengage the spring-loaded pins 64 from the lid lock orifice 66, a user may simply push a trigger 65 connected to the spring-loaded pin 64. Moreover, each of the compartment lid 67 or removable tray attachment 61 may comprise a plurality of lid slots 63 extending therethrough, wherein a divider tooth 50 (described in detail below) may extend through the lid slots 63 to allow for a compartment with an adjustable height.

Each divider may comprise a narrow shaft long enough to extend from one end of a compartment's interior to the opposite end. A series of teeth 50 may protrude upwards from the shaft at a 90° angle. The teeth 50 may be substantially taller than the shaft and extend nearly as high as the top of the respective compartment 47. Between each pair of adjacent teeth 50 is a gap 51, wherein the center of each gap comprises a slot 52 allowing another divider to cross it perpendicularly. The divider's teeth 50 may be shaped such that the align with and pass through slots 63 in a compartment lid 67, or two combined removable tray attachments 61 functioning as such, when a user presses the lid 67 downwards into the compartment 47 to adjust the height therein.

Due to the structure of the workstation 1 of the present disclosure, a user may be provided with a device with wide-spread legs with crossbars and anti-tip devices that allows a user to utilize a unit that is extremely lightweight without the risk of the workstation 1 tipping.

To use the workstation 1 of the present disclosure, a user may simply unfold the platforms 2, 3. The scissor-legs may then be extended to their desired height. Removable tray attachments 61 may be attached to the platform 2, 3, if desired, and anti-tip boots may be attached to the crossbar(s) 78. The workstation 1 may then be used to support a personal item, such as a laptop, a monitor, or the like. A device may be secured to the workstation 1 using a securement clip. For transport or storage purposes, the user may simply fold the platforms 2, 3 together and, if desired, attach optional storage compartments 47 to the workstation 1. Depending on the items being stored, the compartments 47 may have dividers and/or a lid engaged therewith.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A height adjustable and portable sit to stand workstation, the workstation comprising:

a right platform attached to a left platform;

a pair of left upper legs pivotally attached to a bottom surface of the left platform;

a pair of right upper legs pivotally attached to a bottom surface of the right platform;

a leg axle operatively connected to an end of each of the pair of left upper legs distal from the left platform and operatively connected to an end of each of the pair of right upper legs distal from the right platform;

a pair of lower right legs operatively connected to the leg axle; and a pair of lower left legs operatively connected to the leg axle, wherein:

the pair of left upper legs, the pair of right upper legs, the pair of left lower legs, and the pair of right lower legs work together with the leg axle to create a scissor-leg construction.

2. The workstation of claim 1, wherein:

the pair of left upper legs comprises a first left upper leg and a second left upper leg;

the pair of right upper legs comprises a first right upper leg and a second right upper leg; and each of the first left upper leg, the second left upper leg, the first right upper leg, and the second right upper leg has an extendable length.

3. The workstation of claim 2, wherein:

the workstation comprises at least one removable tray attachment;

when each of the first left upper leg, the second left upper leg, the first right upper leg, and the second right upper leg is extended to its greatest length, the right platform and the left platform are spaced apart; and the at least one removable tray attachment is attached to a leftmost edge of the right platform and a rightmost edge of the left platform, creating an elongated workstation surface.

4. The workstation of claim 1, wherein:

the workstation comprises at least one removable tray attachment; and the at least one removable tray attachment includes a tray brace extending therefrom, the tray brace designed to engage with a tray brace receptacle in the surface of a member selected from the group consisting of the right platform and the left platform.

5. The workstation of claim 1, wherein:

the pair of lower right legs comprises a first lower right leg and a second lower right leg attached to one another with a right crossbar;

the pair of lower left legs comprises a first lower left leg and a second lower left leg attached to one another with a left crossbar; and anti-tip devices are removably attached to each of the right crossbar and the left crossbar.

6. The workstation of claim 1, wherein:

the pair of lower right legs comprises a first lower right leg and a second lower right leg;

each of the first lower right leg and the second lower right leg comprises a right fixed lower leg segment and a right traveling lower leg segment extending from the right fixed lower leg segment;

the right traveling lower leg segment is designed to telescope outward from the right fixed lower leg segment;

each of the first lower left leg and the second lower left leg comprise a left fixed lower leg segment and a left traveling lower leg segment extending from the left fixed lower leg segment; and the left traveling lower leg segment is designed to telescope outward from the left fixed lower leg segment.

7. The workstation of claim 1, wherein:

the workstation includes at least one storage compartment attached to a surface of at least one member selected from the group consisting of the right platform and the left platform;

the at least one storage compartment comprises:

a floor and walls extending upward from the floor; and a symmetrical series of divider mounts lining interior surface of the walls; and an arrangement of linear channels positioned on the floor;

each divider mount is designed to hold an end of an insertable divider in place; and each insertable divider comprises:

a shaft;

a series of teeth protruding upwards from the shaft;

a gap positioned between each pair of adjacent teeth;

a slot positioned in a center of each gap, the slot allowing an additional divider to cross a first divider perpendicularly.

8. The workstation of claim 1, further comprises a compartment lid removably engaged with the walls of the compartment, the compartment lid comprising:

a plurality of lid slots extending therethrough, each lid slot sized to accommodate one of the series of teeth.

9. The workstation of claim 8, wherein the compartment lid comprises a pair of the removable attachment trays connected to one another.

10. The workstation of claim 1, further comprising:

a handle, the handle comprising a member selected from the group consisting of a ventilation shaft extending through at least one of the right platform and the left platform;

a handle orifice extending through an edge of at least one of the right platform and the left platform; and at least one crossbar attached to one of the pair of lower right legs and the pair of lower left legs, the at least one crossbar extending outwardly past an edge of both the right platform and the left platform when the right platform and the left platform are in a folded configuration.

11. The workstation of claim 1, further comprising at least one removable tray attachment removably engaged with a surface of a member selected from the group consisting of the right platform and the left platform.

12. The workstation of claim 1, further comprising storage compartments designed to removably attach to the workstation.

* * * * *